US006068448A

United States Patent [19]

Muratsubaki et al.

[11] Patent Number: 6,068,448

[45] Date of Patent: May 30, 2000

[54] PRESSURE HYDRAULIC PUMP HAVING FIRST AND SECOND SYNCHRONOUSLY DRIVEN RECIPROCATING PISTONS WITH A PRESSURE CONTROL STRUCTURE

[75] Inventors: Ryoji Muratsubaki, Kurobe; Yukiaki Nagata, Uozu; Osamu Honokidani, Toyama; Masanori Kanemitsu, Uozu; Masanori Takimae, Toyama; Shinko Yamagishi, Uozu; Tadashi Urasawa, Toyama; Tadashi Sugimori, Uozu, all of Japan

[73] Assignee: Sugino Machine Limited, Toyama, Japan

[21] Appl. No.: 08/761,871

[22] Filed: Dec. 9, 1996

[51] Int. Cl.[7] ..... F04B 49/06; F04B 39/10

[52] U.S. Cl. ..... 417/44.2; 417/212; 417/251; 417/321; 417/536

[58] Field of Search ..... 417/212, 250, 417/244, 254, 533, 534, 535, 536, 246, 247, 321, 362, 44.2, 251; 277/510, 529, 531, 532, 941

[56] References Cited

U.S. PATENT DOCUMENTS

| | | | |
|---|---|---|---|
| 2,592,836 | 4/1952 | Weber | 103/11 |
| 3,010,641 | 11/1961 | Peregrine | 230/51 |
| 4,883,409 | 11/1989 | Strohmeier | 417/43 |
| 5,526,962 | 6/1996 | Huggenberger | 222/276 |
| 5,767,883 | 6/1998 | Castro et al. | 417/44.2 |
| 5,865,602 | 2/1999 | Nozari | 417/212 |

OTHER PUBLICATIONS

Grainger Catalog # 380 p. 1795, Dec. 1991.

*Primary Examiner*—Charles G. Freay
*Attorney, Agent, or Firm*—Evenson, McKeown, Edwards & Lenahan, P.L.L.C.

[57] ABSTRACT

A high pressure hydraulic pump apparatus constituting a two-stage pressurizing hydraulic booster combining a pair of plunger pumps. The first and second pumps are driven into a push-pull synchronous operation at the equal stroke with each other. The per-stroke displacement of the first pump is greater than that of the second pump. The first pump draws by self-suction the liquid from a reservoir while the second pump is on the pressurizing and delivery stroke. When the first pump is on the delivery stroke, the liquid pressurized to a certain intermediate pressure by the first pump is sucked into the second pump. During the next reverse stroke the second pump further pressurizes and discharges the liquid while the first pump effects the suction stroke. At the final pressurization by the second pump, the driving stroke length of the pump is controlled to a limited value which provides a minimum delivery flow required for the interior of a load vessel to attain a target pressure in accordance with the compressibility of the liquid and the detection of a load pressure.

10 Claims, 5 Drawing Sheets

PRESSURE HYDRAULIC PUMP HAVING FIRST AND SECOND SYNCHRONOUSLY DRIVEN RECIPROCATING PISTONS WITH A PRESSURE CONTROL STRUCTURE

BACKGROUND OF THE INVENTION

1. Field of the Invention

The present invention relates to a high pressure hydraulic pump apparatus, and more particularly, to a plunger pump apparatus which is equally called as a hydraulic booster.

2. Related Background Art

Where a high pressure liquid is used for the cutting of works, the pressurization within pressure vessels or the like, high pressure hydraulic pump apparatus, based on the Pascal's principle and called as hydraulic booster pumps, are used widely as high pressure liquid supply source. The hydraulic booster pump produces a high delivery pressure by increasing an inlet pressure in inverse proportion to the pressure receiving area ratio of a plunger piston. Known types of hydraulic booster pumps are roughly classified into single-acting boosters adapted to intermittently deliver a high pressure liquid of a given flow rate from the outlet for every stroke and double-acting boosters comprising a pair of single-acting boosters interconnected via check valves and directional control valves to deliver a high pressure liquid of a continuous flow in time from the outlet.

A variety of mechanisms are heretofore known for hydraulically driving the plunger of a hydraulic booster. In the case of the hydraulic booster of a free piston type, for example, the interior of the pressure cylinder is divided into a processing chamber and a pressurizing chamber by the free piston and a liquid to be processed, is introduced to fill the processing chamber and pressurized by the movement of the free piston caused by the hydraulic oil introduced into the pressurizing chamber. Such a pressure cylinder is connected in parallel with a number of the similar pressure cylinders through valves and a phase difference in operation is provided for the free pistons of the respective cylinders, thereby attaining an efficient pressurized processing.

While this free piston-type hydraulic booster is advantageous in that during the operation of the free piston practically no pressure difference is caused between its chambers on the both sides thus tending to reduce the wear of the packing for sealing the clearance between the free piston and cylinder bore, it has been said to be unsuited in applications involving, for example, the pressure treatment of such beverages and comestibles as jam, fruit juice and wine or medicine due to the danger of the liquid to be processed in the processing chamber being contaminated by the actuating hydraulic oil within the pressurizing chamber.

As hydraulic high pressure pump apparatus for pressurization processing such beverages and comestibles, medicine or the like by a high pressure liquid, electrically-operated hydraulic boosters adapted for operating the plunger pump by a driving mechanism which is completely free of the danger of the liquid to be processed being contaminated by an actuating hydraulic oil, i.e., an electrically-operated motor have been frequently used.

However, the conventional electrically-operated hydraulic booster requires a separate rotary pump for supplying a liquid to be processed into the pressurizing chamber of the main pump. The volume of the rotary pump must be selected with some allowance in consideration of variations in the amount of liquid supplied into the pressurizing chamber of the main plunger pump. The provision of the rotary pump complicates the construction of the booster apparatus on the whole. Also, the liquid to be processed is caused to change in quality during its circulation within the rotary pump. Particularly, if bubbles are allowed to enter into the liquid to be processed prior to its pressurization in the pressurizing chamber of the main plunger pump, a long period of time is required before the liquid to be processed attains the target pressure owing to its pressurization by the plunger pump and thus the work efficiency of the pressurization is deteriorated. In addition, the occurrence of a seal leakage problem of the booster due to the connection of the rotary pump is apprehended.

On the other hand, in the case of the conventional double-action booster the hydraulic system is a single-stage pressurization system so that a sufficiently high delivery pressure cannot be obtained unless the shaft output of the drive motor is increased. In particular, while the use of a higher pressure is desired in the field of the pressurized processing of food products, the use of a high-power drive motor inevitably increases the cost and also it gives rise to the problem of increasing the size of the apparatus on the whole. In addition, the pump driving power must be increased in order to ensure a higher pressure for the delivery pressure performance of the booster. For this purpose, it is necessary to increase the diameter of the screw shaft of the ball screw unit which drives the plunger by converting the rotation output of the motor into a linear reciprocating motion. However, if the ball screw shaft is increased in diameter, the weight of the apparatus is necessarily increased and moreover the load bearing ability is not increased in proportion to the increase in weight with the resulting deterioration of the energy efficiency. Further, irrespective of the single-action booster and the double-action booster, the conventional electrically-operated booster is designed so that even if the load pressure reaches near a preset value and a situation arises in which it is sufficient even if the amount of delivery required for the pressurization of the load is less than the amount of delivery per stroke length of the plunger, the plunger is still caused to reciprocate at the constant stroke length and thus it is wasteful of the power consumption of the drive motor.

SUMMARY OF THE INVENTION

It is the primary object of the present invention to provide a high pressure hydraulic pump apparatus in which a liquid to be supplied to a load is not unnecessarily circulated to prevent any change in the quality of the liquid and which is simple in construction.

It is another object of the present invention to provide a high pressure hydraulic pump apparatus capable of reducing the pressurization time required to reach a target pressure.

It is still another object of the invention to provide a high pressure hydraulic pump apparatus so designed that the adjustment of a pressurizing force for a liquid is easy.

It is still another object of the invention to provide a high pressure hydraulic pump apparatus so designed that even if a rotary pump for liquid supplying purposes is not used together, a high pressure liquid is obtained from a low flow rate without causing a leak in the seal.

It is still another object of the invention to provide a high pressure hydraulic pump apparatus capable of effectively utilizing internally the pressure of a pressurized liquid and thus avoiding any wasteful power consumption.

It is still another object of the invention to provide a high pressure hydraulic pump apparatus capable of variably controlling the stroke length of a pump pressurizing stroke in relation to a load pressure.

It is still another object of the invention to provide a high pressure hydraulic pump apparatus capable of pressurizing a liquid to an ultra-high pressure of over 500 MPa by means of a sufficiently high driving force even without using any driving shaft which is large and heavy.

It is still another object of the invention to provide a high pressure hydraulic pump apparatus so designed that there is no danger of causing a leak through the seal between the cylinder and plunger of a plunger pump over a long period of time even under an ultra-high pressure condition of 500 MPa or over.

In accordance with one aspect of the present invention there is thus provided a high pressure hydraulic pump apparatus comprising:

inlet means adapted to be connected to a reservoir containing a liquid;

outlet means adapted to be connected to a load;

first reciprocating pump means for alternately sucking and delivering the liquid with a predetermined first displacement per unit stroke length;

second reciprocating pump means for alternately sucking and delivering the liquid with a second displacement per unit stroke length smaller than the first displacement;

drive means for synchronously driving the first and second reciprocating pump means with the equal stroke length for each other such that the second reciprocating pump means performs the suction stroke when the first reciprocating pump means is on the delivery stroke and vice versa;

a supply line adapted for connecting the first reciprocating pump means to the inlet means when the first reciprocating pump means is on the suction stroke;

a connecting line for introducing the liquid delivered from the first reciprocating pump means into the second reciprocating pump means when the first reciprocating pump means is on the delivery stroke and the second reciprocating pump means is on the suction stroke;

a delivery line for directing the liquid delivered from the second reciprocating pump means to the outlet means when the second reciprocating pump means is on the delivery stroke; and pressure control means connected to the connecting line for hydraulically controlling the pressure of the liquid in the connecting line.

In accordance with another aspect of the present invention, the high pressure hydraulic pump apparatus further includes a pressure accumulator directly connected to the delivery port of the first reciprocating pump means.

In accordance with still another aspect of the present invention, the supply line includes a first check valve for permitting the flow of the liquid directed to the first reciprocating pump means from the inlet means and for blocking the reverse flow, and the connecting line includes a second check valve for permitting the flow of the liquid directed to the second reciprocating pump means from the first reciprocating pump means and for blocking the reverse flow.

The first reciprocating pump means sucks the liquid from the reservoir on the suction stroke, and when it reverses at the stroke end and enters the pressurizing delivery stroke, the sucked liquid is pressurized and delivered from the delivery port. Since the first reciprocating pump means effects the self-suction of the liquid from the reservoir, there is no need to use any additional rotary pump for supplying liquid as used in the conventional apparatus. Thus, in accordance with the present invention no separate pump for liquid supplying purposes is required with the resulting simplification of the apparatus in construction and also the liquid is not needlessly circulated within the apparatus thereby practically eliminating the generation of bubbles and changes in the quality of liquid.

When the first reciprocating pump means is on the pressurizing delivery stroke, the second reciprocating pump means sucks the liquid which is delivered from the first reciprocating pump means and already pressurized to a certain intermediate pressure. When the first reciprocating pump means reverses at the stroke end and enters the suction stroke, the second reciprocating pump means enters the pressurizing delivery stroke. During the pressurizing delivery stroke, the second reciprocating pump means pressurizes the previously sucked liquid of the intermediate pressure to a higher pressure and delivers it to an external load. In this way, during the reciprocating stroke motion a two-stage pressurization of the liquid by the first and second reciprocating pump means is effected so that even if there is a limit to the amount of pressurization by the second reciprocating pump means, the liquid already raised to a certain intermediate pressure is pressurized thereby reducing the pressurization time on the whole.

Since the displacement per unit stroke length of the second reciprocating pump means is smaller than that of the first reciprocating pump means, during the pressurizing delivery stroke of the first reciprocating pump means the liquid, which is greater than the amount sucked by the second reciprocating pump means, is delivered to the connecting line from the first reciprocating pump means. Of the amount of flow delivered from the first reciprocating pump means, the excess amount of flow exceeding the amount of flow sucked by the second reciprocating pump means is either relieved, for example, to the reservoir at a predetermined pressure by the pressure control means connected to the connecting line or sucked at a predetermined pressure by the pressure accumulator connected to the delivery port of the first reciprocating pump means.

Where the inside of a load, e.g., a closed chamber is filled with a high pressure liquid and pressurized to a target pressure, it is advantageous to effect the setting of the relief pressure of the pressure control means in such a manner that the relief of excess amount of flow by the pressure control means is effected at a certain lower pressure in the vicinity of the target pressure of the load, so that until this vicinity pressure (set value of the relief pressure) is reached by the delivery pressure of the first reciprocating pump means under the conditions where the load is lower than the target pressure, all of the excess amount of flow can be directly delivered to the load and the pressurization time of the load can be reduced further.

The first and second reciprocating pump means can each be constituted by a plunger pump. A first plunger of a first plunger pump constituting the first reciprocating pump means has a pressurization cross-section area greater than that of a second plunger of a second plunger pump constituting the second reciprocating pump means. The plungers of the first and second plunger pumps are connected in common to a drive member which is moved linearly and reciprocally by a drive motor and the plungers are moved as a unit. In this case, preferably a servo electric motor is used as the drive motor and the direction of rotation of this servo electric motor is changed at a variably set period. Also, the drive member may for example be composed of a ball screw mechanism which converts the reversible rotation output of the electric motor into a linear reciprocating motion.

Where the pressure accumulator is connected to the delivery port of the first reciprocating pump means, while many different types of accumulators, such as a weight loaded type and a spring loaded type can be used as the accumulator, preferably one which accumulates power by a gaseous pressure, particularly a bladder type or piston type hydro-pneumatic accumulator is used. The residual pressure accumulated during the delivery stroke of the first reciprocating pump means can be effectively utilized as a force for energizing the stroke movement of the pump during the suction stroke of the first reciprocating pump means thereby contributing toward improving the efficiency due to the reduced mechanical power.

In accordance with still another aspect of the present invention, the high pressure hydraulic pump apparatus includes a pressure detector for detecting the load pressure of a high pressure liquid delivered to the load from the outlet means, and a controller for controlling said drive means to variably control a driving stroke length of said first and second reciprocating pump means in accordance with the load pressure detected by the pressure detector and the volume of the load to be filled with the high pressure liquid so as to increase the load pressure to a predetermined pressure value. In this case, the controller performs the following controls.

In other words, when pressurizing the interior of the load chamber having the known volume V up to a predetermined target pressure value $p_M$ by the high pressure liquid delivered from the high pressure hydraulic pump apparatus, the total liquid volume $W_M$ within the load chamber upon the interior of the load chamber reaching the target pressure $p_M$ is preliminarily calculated in accordance with the volume V and a compressibility $\beta_M$ of the working liquid at the target pressure $p_M$. The load pressure p of the high pressure liquid delivered to the load chamber by the delivery stroke of the second reciprocating pump means is detected by the pressure detector. Prior to the suction stroke of the second reciprocating pump means following the said delivery stroke, the total liquid volume W within the load chamber at the load pressure p is calculated in accordance with a compressibility $\beta$ of the liquid at the load pressure p and the volume V of the load chamber. The ratio $\Delta W/Q_0$ between the total liquid volume difference $\Delta W=W_M-W$ and the unit delivery amount $Q_0$ by a single pump stroke at the full stroke length which is preliminarily given as an inherent constant to the second reciprocating pump means is calculated. The controller controls the drive unit so that when the value of this ratio is 1 or over, the reciprocating pump means are driven at the full stroke length. The value of this ratio $\Delta W/Q_0$ is a function of the detected output of the pressure detector and the value of this ratio is sequentially monitored by the controller. The controller controls the drive unit so that when the value of the ratio $\Delta W/Q_0$ is less than 1, the stroke length on the immediately following suction stroke of the second reciprocating pump means is limited to a reduced stroke length corresponding to the product of the said full stroke length and the said ratio and it also controls the reversing timing of the drive unit so that after the suction stroke by this limited stroke length, the second reciprocating pump means is immediately reversed to the delivery stroke.

With the high pressure hydraulic pump apparatus equipped with the pressure detector and the controller, it is possible to reduce the pressurization time from the start to the time that the internal pressure of the load chamber reaches the target pressure value. The reason is that instead of always moving the reciprocating pump means at the full stroke length, at the final stage of the pressurization the minimum delivery flow rate required for the interior of the load chamber to attain the target pressure is calculated and the pump operating stroke is limited to the stroke length corresponding to the calculation result thereby delivering only the minimum required amount of flow.

For instance, describing in detail the case in which water is used as the liquid to be pressurized, in accordance with the compressibility $\beta_M$ of water upon reaching the target pressure $p_M$, the total volume $W_M$ of water required for filling the load chamber of the constant volume V in the condition compressed with this compressibility $\beta_M$, is calculated. Note that here the unit of pressure is (kgf/cm$^2$).

$$\beta=\{P(p)-1\}/P(p) \tag{1}$$

where P(p) is $$P(p)=\{(2.996\times10^8+p\times9.8\times10^4)/2.996\times10^8\}^{0.1368}$$

The volume W of water required for filling the load chamber of the volume V in the condition of the pressure p (kgf/cm$^2$) is calculated from the following equation:

$$W=V/(1-\beta) \tag{2}$$

Therefore, the volume $W_M$ of water required for filling the load chamber of the volume V in the condition of the target pressure $p_M$ (kgf/cm$^2$) is:

$$W_M=V/(1-\beta_M) \tag{3}$$

where $$\beta_M=\{P(p_M)-1\}/P(p_M)$$

$$P(p_M)=\{(2.996\times10^8+p_{mx}9.8\times10^4)/2.996\times10^8\}^{0.1368}$$

By detecting the load pressure p of the high pressure water delivered to the load chamber, the compressibility $\beta$ of the high pressure water at the time of the detection is calculated from the above equation (1), and in accordance with this compressibility $\beta$ and the volume V of the chamber the total volume W of water within the load chamber at that time is calculated from equation (2).

Thus, in accordance with the value of the load pressure p at the time of the completion of the delivery stroke of the reciprocating pump the then current total volume W of water is calculated from equations (1) and (2), and when the difference between it and the total volume $W_M$ of water within the load chamber upon reaching the target pressure $p_M$ by the load chamber, i.e., $\Delta W=W_M-W$ is calculated, the remaining volume of the compressed water which must be supplied into the chamber for increasing the pressure within the chamber to the target pressure value is determined.

The unit flow rate $Q_0$ by a single pump stroke of the reciprocating pump at the full stroke length is known as the value inherent to the pump, and therefore the ratio $\Delta W/Q_0$ between $\Delta W$ and $Q_0$ gives the required number of strokes for pressurizing up to the target pressure value.

In this way, when each time the delivery stroke of the reciprocating pump is completed, if the value of the then current calculated ratio $\Delta W/Q_0$ is greater than 1, the reciprocating pump is operated at the full stroke length for the following stroke, whereas when the value of the ratio $\Delta W/Q_0$ is less than 1, the stroke length for the immediately following suction stroke is limited to the reduced stroke length corresponding to the product of the full stroke length and the said ratio and moreover the reciprocating pump is immediately reversed to the delivery stroke after the suction stroke by the limited stroke length.

By so doing, the reciprocating pump is prevented from effecting its pump stroke with any wasteful stroke length at the final stage of the pressurization and the pressurization time is reduced further due to the elimination of any waste of the stroke length for both the suction and delivery strokes, with the result that the interior of the load chamber attains the target pressure value when the delivery stroke with the limited stroke length is completed.

Since, in the case of this type of high pressure reciprocating pump, the time required for the reciprocating stroke movement of the suction stroke and the delivery stroke is generally greater than about several tens seconds, to introduce the load pressure p upon the completion of the delivery stroke into a computer and complete the necessary calculation before the start of the next delivery stroke can be easily realized by virtue of the ordinary electronic techniques.

In accordance with still another aspect of the present invention, the high pressure hydraulic pump apparatus includes third reciprocating pump means connected in parallel to the second reciprocating pump means for supplementing a liquid to the second reciprocating pump means so as to additionally increase the pressure of the liquid sucked into the second reciprocating pump means, and a drive actuator for driving the third reciprocating pump means independently of the first and second reciprocating pump means, and in this case the third reciprocating pump means has a third displacement which is substantially equal to the difference between the first and second displacements.

The third reciprocating pump means constitutes pressure control means for sucking the amount of liquid corresponding to the excess amount of the liquid delivered from the first reciprocating pump means (the difference between the first and second displacements) when the second reciprocating pump means is on the suction stroke. When the second reciprocating pump means reaches the stroke end, it does not immediately reverse to enter the delivery stroke but halts at the stroke end (therefore, the first reciprocating pump means also halts) and during this halting only the third reciprocating pump means comes into the pressurization stroke.

During its pressurization stroke, the third reciprocating pump means first pressurizes the liquid within the pressurizing chamber of the second reciprocating pump means by the delivery operation so that when a predetermined target pressure is reached, the stroke movement is stopped and a pressure holding operation is effected. Prior to the delivery stroke to the load, the third reciprocating pump means returns the pressure within the pressurizing chamber of the second reciprocating pump means to the pressure condition before the pressurization stroke by the return operation. Thereafter, both of the second and third reciprocating pump means come into the delivery stroke and the delivery to the load is effected. In this way, the liquid pressurized within the pressurizing chamber of the second reciprocating pump means by the third reciprocating pump means is reduced in pressure by the smooth return operation of the third reciprocating pump means prior to the delivery to the load, with the result that no abnormal force is applied to the precision super high-pressure components of the outlet valve and the life of the components used in the apparatus is not decreased. Also, since the liquid delivered to the load is delivered while being smoothly increased in pressure up to the target pressure and any rapid injection to the load is avoided, there is no danger of the liquid being changed in quality.

In accordance with still another aspect of the invention, the drive means includes a motor for generating a mechanical reversible rotation output and a motion conversion unit for converting the reversible rotation output taken from the motor to a linear reciprocation motion and transmitting the same to the first and second reciprocating pump means. The motion conversion unit includes a plurality of feed screw shafts arranged in parallel to each other so as to be driven into rotation in common by the motor, a plurality of nuts respectively threadedly engaged with the feed screw shafts so as to be moved synchronously with one another, and a traverse member for holding together the nuts, with both the first and second reciprocating pump means being connected to the traverse member.

Since, in the motion conversion unit, the plurality of nuts respectively threadedly engaged with the parallel feed screw shafts are integrally held on the traverse member, even if ball screw mechanisms are for example employed for the feed screw shafts, there is no possibility of the individual nuts rotating together with the screw shafts. Also, since the driving load can be distributed among the plurality of feed screw shafts, the load bearing strength of the individual feed screw shafts can be designed relatively low and the diameter of the feed screw shafts can be reduced, thus making it possible to reduce the increase in the weight of the apparatus.

As regards the arrangement of the plurality of feed screw shafts, it is preferable to arrange so that within the peripheral surface of a geometrically virtual cylinder the axial centers of the respective feed screw shafts are parallel to the central axis of the cylinder, particularly they are preferably equally spaced from each other within the peripheral surface of the cylinder. In this case, the plungers of the respective reciprocating pump means connected to the traverse member should preferably be arranged concentrically with the central axis of the cylinder.

In accordance with still another aspect of the present invention, the first reciprocating pump means includes a first plunger pump, the second reciprocating pump means includes a second plunger pump, a first plunger of the first plunger pump having a pressurization cross-sectional area greater than that of the second plunger of the second plunger pump, and the first and second plungers are connected in common to the drive means so as to make reciprocating movements as a unit with each other.

In accordance with another preferred aspect of this invention, the second plunger pump includes a cylinder bore within which the second plunger reciprocates, an annular gap formed between the outer periphery of the second plunger and the inner periphery of the cylinder bore over the limited axial length area facing the end of the cylinder bore and having a first inner end face on the innermost side of the cylinder bore and a second inner end face on the opposing end side, and a sealing structure arranged between the first and second inner end faces within the annular gap. The sealing structure includes a resilient ring, a packing ring more hard than the resilient ring, a backup ring higher in yield strength than the packing ring and a rigid ring member having a first conical end face on the second inner end face and gradually increasing in diameter from the innermost side of the cylinder bore toward the end side, which are arranged in this order from the first inner end face to the second inner end face.

The resilient ring has an outer periphery facing the inner periphery of the cylinder bore and a conical inner periphery which gradually increases in diameter from the innermost side to the end side of the cylinder bore.

The packing ring has an inner periphery facing the outer periphery of the second plunger, a conical outer periphery facing both the conical inner periphery of the resilient ring and the inner periphery of the cylinder bore and a second conical end face gradually decreasing in diameter from the innermost side to the end side of the cylinder bore.

The back-up ring has a first end face facing the first conical end face of the rigid ring member, an outer periphery facing the inner periphery of the cylinder bore, an inner periphery facing the second conical end face of the packing ring and a second end face forming, along with the inner periphery of the cylinder bore and the first conical end face of the rigid ring member, an annular space which is triangular in section on the end side of the cylinder bore.

This sealing structure is designed so that the sealing force of the backup ring on the cylinder bore inner periphery is increased as the pressure of the liquid within the cylinder bore is increased and therefore an excellent sealing performance can be maintained even if the pressure of the second plunger pump attains an ultra-high pressure of over 500 MPa.

The above and other features and advantages of the present invention will be more apparently understood from the following description of its preferred embodiments shown simply for illustrative purposes only without any intention of limitation, taking in conjunction with the accompanying drawings.

DESCRIPTION OF THE PREFERRED EMBODIMENTS

Figure 1:
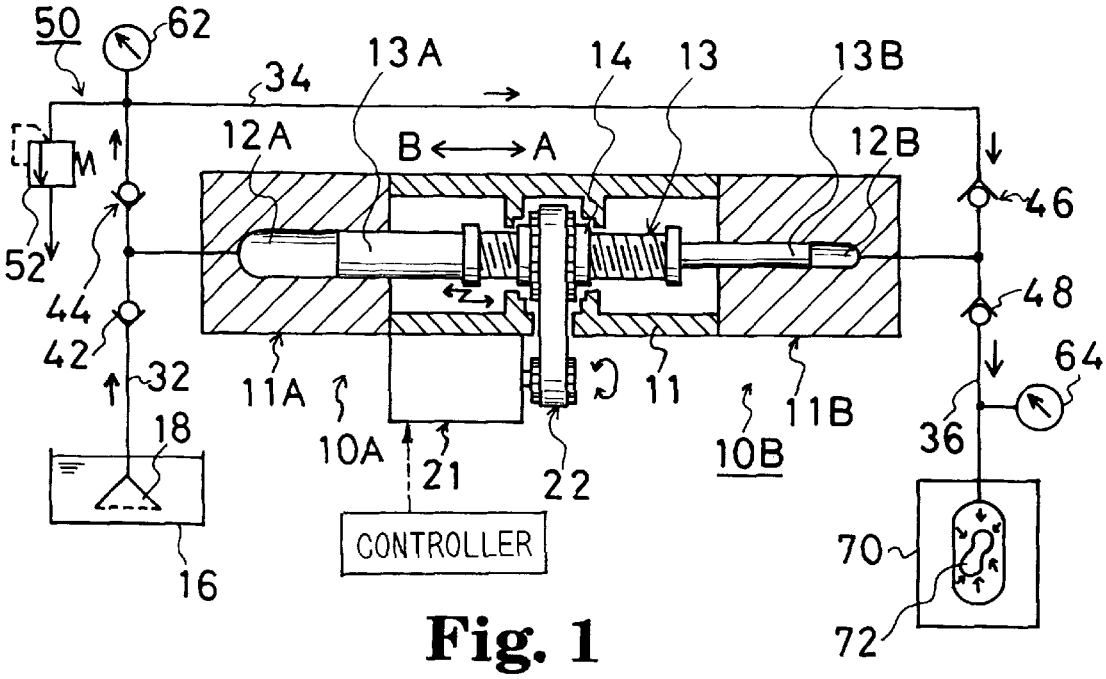
FIG. 1 is a schematic diagram showing the construction of the high pressure hydraulic pump apparatus according to a first embodiment of the present invention.

The high pressure hydraulic pump apparatus according to the first embodiment of the invention shown in FIG. 1, is used for the purpose of supplying a high pressure liquid to a pressure vessel 70 having a certain volume as a load for processing a food and subjecting food 72 in the vessel 70 to pressurizing process. However, this application is a mere example and it is needless to say that it is possible for example to use as a load a nozzle unit for ejecting a high pressure liquid to cut works composed of various materials.

In FIG. 1, a plunger pump 10A or first reciprocating pump means comprises a low pressure-side cylinder 11A and a relatively large-diameter plunger 13A which reciprocates within the cylinder 11A to periodically change the volume of a pump chamber 12. The plunger 13A sucks the liquid into the pump chamber 12A by moving in the direction of an arrow A shown (suction stroke) and pressurizes and delivers the liquid sucked during the suction stroke by conversely moving in the direction of an arrow B (delivery stroke).

A plunger pump 10B or second reciprocating pump means comprises a high pressure-side cylinder 11B and a relatively small-diameter plunger 13B which reciprocates in the cylinder 11B to periodically change the volume of a pump chamber 12B. The plunger 13B moves in the direction of the arrow B shown to suck the liquid into the pump chamber 12B (suction stroke) and conversely moves in the direction of the arrow A to pressurize and deliver the liquid sucked during the suction stroke (delivery stroke).

The displacements per unit stroke length of the plunger pumps 10A and 10B correspond respectively to the pressurizing cross-sectional areas of the plungers 13A and 13B (the cross-sectional areas of the pump chambers 12A and 12B) so that the plunger pump 10B is smaller in displacement per unit stroke length than the plunger pump 10A.

By fixedly integrally mounting the low-pressure cylinder 11A and the high-pressure cylinder 11B at the ends of a cylinder house 11, the plunger pumps 10A and 10B are conversely and substantially coaxially arranged so that their plunger tail ends oppose each other and the opposing plunger tail ends are connected as a unit by a ball screw shaft 13 serving as a drive member which is caused to reciprocate linearly by a driving motor. This ball screw shaft 13 is periodically axially reciprocated so that the plungers 13A and 13B are integrally reciprocated reversibly in association with each other with the equal stroke length and thus the plunger pumps 10A and 10B perform a so-called push-pull pressurizing operation in which when one of them is on the suction stroke, the other performs the delivery stroke.

In order that the plungers 13A and 13B of the plunger pumps 10A and 10B may be reciprocated as a unit by the ball screw shaft 13, mounted on the cylinder housing 11 is a reversible servo motor 21 which is periodically changed in rotation direction by a servo controller which is not shown, and rotary nuts 14 adapted for precision threaded engagement with the ball screw shaft 13 through the balls are rotatably supported at the fixed positions of the housing 11, with the rotary shaft of the servo motor 21 and the rotary nuts 14 being connected by a rotation transmitting unit formed by a toothed endless belt 22. As a result, when the motor 21 rotates in one direction, the ball screw shaft 13 is moved in the direction of the arrow A due to the rotation of the rotary nuts 14, whereas when the motor 21 rotates in the other direction, the ball screw shaft 13 is moved in the direction of the arrow B due to the rotation of the rotary nuts 14.

The liquid is stored in a reservoir 16 and an inlet or suction port 18 with a filter is opened into the liquid in the reservoir 16. A first check valve 42 is provided on a supply line 32 connecting the suction port 18 and the pump chamber 12*a*, and the check valve 42 functions so that the supply line 32 is opened to introduce the liquid sucked through the suction port 18 into the pump chamber 12A during the suction stroke of the low-pressure plunger pump 10A, whereas during the delivery stroke of the pump 10A the supply line 32 is closed by its delivery pressure to prevent the liquid delivered from the pump chamber 12A from flowing back into the reservoir 16.

The low-pressure pump chamber 12A and the high-pressure pump chamber 12B are connected by a connecting line 34, and arranged in series on the supply line 34 are a second check valve 44 and a third check valve 46 which are opened by the forcing of the delivered liquid from the low-pressure plunger pump 10A. These check valves 44 and 46 are arranged with such orientation that the liquid flow from the pump chamber 12*a* side to the pump chamber 12B side is permitted and the reverse liquid flow is blocked.

A delivery line 36 for directing the high pressure liquid delivered from the pump chamber 12B of the high-pressure plunger pump 10B to the load (pressure vessel 70) through the outlet, is provided with a fourth check valve 48 which is opened by the forcing of the pressurized liquid from the third check valve 46 or the pump chamber 12B and the check valve 48 blocks the reverse flow from the load.

Connected to the connecting line 34 is a branch circuit 50 which is branched off the flow passage between the second check valve 44 and the third check valve 46 and the branch circuit 50 includes a pressure controller consisting of a relief valve 52 for setting the upper limit of the delivery pressure from the low-pressure plunger pump 10A. As will be described later, the branch circuit 50 including the relief valve 52 is designed so that of the amount of delivery flow from the low-pressure plunger pump 10A any excess amount of flow exceeding the amount of flow sucked into the pump chamber 12B of the high-pressure plunger pump 10A is sucked at a predetermined pressure. It is to be noted that a pressure gauge 62 connected to the connecting line 34 constitutes low pressure-side pressure detecting means for detecting the pressure in the flow passage controlled by the relief valve 52, and a pressure gauge 64 connected to the delivery line 36 constitutes high pressure-side pressure detecting means for detecting the load pressure.

Assuming now that the load or the pressure vessel 70 is connected to the outlet of the delivery line 36 and the pressurizing chamber filled with the liquid within the pressure vessel 70 is pressurized to a target pressure by the high pressure liquid delivered from the delivery line 36, if the servo motor 21 is rotated by a controller which is not shown so that it reverses periodically at predetermined reversion period and rotation speed, this reversion rotation motion is converted to a linear reciprocating motion by the rotary nuts 14 and the ball screw shaft 13 and the pair of plungers 13A and 13B connected to the ends of the ball screw shaft 13 are brought into a reciprocating motion as a unit in the directions of the arrows A and B in the Figure in accordance with the predetermined reversion period and the speed.

By virtue of the reciprocating motion of the plungers 13A and 13B, the low-pressure plunger pump 10A and the high-pressure plunger pump OB reversibly operate in association with each other at the equal stroke length. In other words, when the plungers 13A and 13B move in the direction of the arrow A, the low-pressure plunger pump 10A is on the suction stroke and the high-pressure plunger pump 10B is on the delivery stroke, whereas when the plungers 13A and 13*b* move in the direction of the arrow B, the low-pressure plunger pump 10A is on the delivery stroke and the high-pressure plunger pump 60B is on the suction stroke, and also the high-pressure plunger pump 10B is smaller in displacement per unit stroke length than the low-pressure plunger pump 10A.

When the plungers 13A and 13B start to move in the direction of the arrow A, the low-pressure plunger pump 10A enters the suction stroke and the movement of the plunger 13A gradually increases the volume of the pump chamber 12A thereby introducing the liquid within the reservoir 16 into the pump chamber 12A by self-suction through the supply line 32. In this case, the first check valve 42 in the supply line 32 is opened due to the fact that the pump chamber 12A side becomes more negative in pressure than the suction port 18 side, whereas the second check valve 44 in the connecting line 34 remains closed due to the fact that pump chamber 12A side becomes more negative in pressure than the connecting line 34 side. In this way, due to the self-suction of the liquid by the low-pressure plunger pump 10A from the reservoir 16, there is no need to use such liquid supply pump as in the past, and also due to the fact that the liquid is not unnecessarily circulated, there is practically no danger of causing occurrence of bubbles and changes in the liquid quality.

When the plunger 13A reverses at the stroke end of the movement in the direction of the arrow A and starts moving in the direction of the arrow B, the low-pressure plunger pump 10A enters the delivery stroke and due to the movement of the plunger 13A the volume of the pump chamber 12A is gradually decreased and the liquid within the pump chamber 12*a* is pressurized and delivered to the connecting line 34. At this time, the liquid delivered from the pump chamber 12A of the low-pressure plunger pump 10A not only closes the first check valve 42 but also it is supplied to the high-pressure side by force opening the second check valve 44 and the third check valve 46 on the connecting line 34, and at this time the high-pressure plunger pump 10B is on the suction stroke thus causing the liquid issuing from the check valve 46 to be sucked into the pump chamber 12B.

During the delivery stroke of the low-pressure plunger pump 10A the liquid issuing from the check valve 46 has already been pressurized up to a certain intermediate pressure so that during its suction stroke the high-pressure plunger pump 10B sucks the liquid pressurized to the intermediate pressure into the pump chamber 12B. When the low-pressure plunger pump 10A again reverses at the stroke end of the movement in the direction of the arrow B and enters the suction stroke, the high-pressure plunger pump 10B enters the delivery stroke. During this delivery stroke, the high-pressure plunger pump 10B further pressurizes the previously sucked liquid of the intermediate pressure to a higher pressure and delivers it to the pressurizing chamber of the pressure chamber 70 connected to the outlet through the fourth check valve 48.

In this way, during the reciprocating stroke movements the two-stage pressurization of the liquid by the low-pressure plunger pump 10A and the high-pressure plunger pump 10B is performed so that even if the amount of pressurization by the high-pressure plunger pump 10B is limited, it pressurizes the liquid already pressurized to a certain intermediate pressure and therefore the pressure increasing time on the whole can be reduced.

The high-pressure plunger pump 10B is smaller in displacement per unit stroke length than the low-pressure plunger pump 10A so that the amount of liquid greater than that sucked by the high-pressure plunger pump 10B is delivered to the delivery line (the connecting line 34) of the low-pressure plunger pump 10A from the pump chamber 12A during the delivery stroke of the low-pressure plunger pump 10A. Of the amount of delivery flow from the low-pressure plunger pump 10A, any excess amount of flow exceeding the amount of flow sucked into the pump chamber 12B of the high-pressure plunger pump 10B is sucked at the predetermined set pressure of the relief valve 52 by the branch circuit 50 connected to the connecting line 34 or the delivery line of the low-pressure plunger pump 10A and it is returned to the reservoir 16.

Now, where the closed space filled with the liquid as the load or the pressure chamber (70) is pressurized up to a target pressure by a high pressure liquid, if the pressure setting of the relief valve 52 is effected in such a way that the suction of an excess amount of flow by the branch circuit 50 is effected at a vicinity pressure which is lower but close to the target pressure, until the vicinity pressure is attained by the pressure of the connecting line 34 which receives the liquid delivered by the low-pressure plunger pump 10A in a condition where the load pressure is lower than the target pressure, the excess amount of flow can be delivered as a compressed amount to the pump chamber 12B from the check valve 46 or directly to the pressure vessel 70 through the check valve 48 and the pressurization time of the load can be reduced further.

Figure 2A:
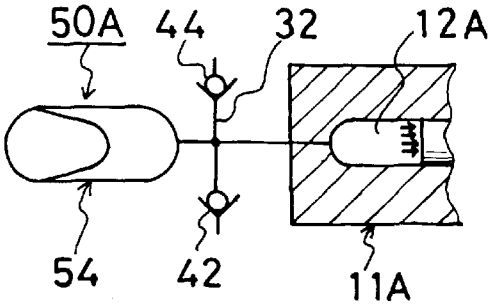
FIGS. 2A and 2B are schematic diagrams showing respectively the principal parts of two modifications of the embodiment shown in FIG. 1.
Figure 2B:
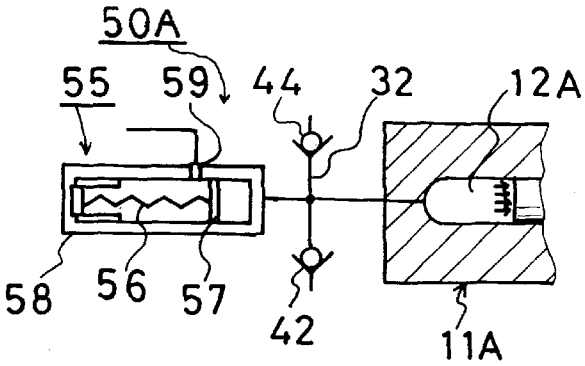

It is to be noted that while, in this embodiment, the branch circuit 50 including the pressure controller formed by the relief valve 52 is branched from between the second check valve 44 and the third check valve 46, as shown in FIG. 2A or 2B, it is possible to branch another branch circuit 50A from the connecting line 34 between the first check valve 42 and the second check valve 44 and provide the branch circuit 50A with an accumulator 54 or 55 in place of the branch circuit 50 or in addition to the branch circuit 50.

The accumulator 54 of FIG. 2A performs its pressure storing operation by sucking the excess amount of flow from among the delivered amount of flow from the low-pressure plunger pump 10A, and where it is used in combination with the relief valve 52, its operating pressure value may be set to a lower value than the pressure setting of the relief valve 52 so as to allow the relief valve 52 to function as a safety valve.

The accumulator shown in FIG. 2A is a bladder type hydropneumatic accumulator which stores its power by means of a pneumatic pressure, and the use of this gas loaded type of accumulator has the effect of reducing the weight of the apparatus with an excellent pressure storing characteristic. On the other hand, the accumulator shown in FIG. 2B is a spring loaded type accumulator in which a piston 57 energized by a spring 56 is mounted within a cylinder 58, and in this case the cylinder 58 is provided with an opening 59 which opens to the outside, as for example, the reservoir 16 or the like when the piston 57 retreats to some extent thereby providing the accumulator 55 with a safety valve function of releasing the branch circuit 50A to the reservoir side when the delivery pressure of the low-pressure plunger pump 10A becomes excessively large. Note that in addition to those shown by way of examples, various other types of accumulators such as a weight loaded type utilizing a weight may be used with the branch circuit 50A and the present invention is not limited to the illustrations of FIGS. 2A and 2B.

Further, particularly the branch circuit 50A having such an accumulator may be arranged so as to always communicate with the pump chamber 12A whereby the residual pressure stored in the accumulator during the delivery stroke of the low-pressure plunger pump 10A is effectively utilized as a force for energizing the movement of the plunger 13A in the direction of the arrow A during the suction stroke of the low-pressure plunger pump 10A, thereby making it possible to improve the efficiency due to the reduced pump power.

As the result of the repetition of the reciprocating pump strokes in the directions of the arrows A and B, mainly in response to every delivery operation of the high-pressure plunger pump 10B due to the plunger movement in the direction of the arrow A, the pressure within the pressurizing chamber of the pressure vessel 70 as the load is increased stepwise and the manner of the pressure increase is monitored through a pressure detection by the pressure gauge 64 so as to stop the operation of the motor 21 when the interior of the vessel 70 attains a predetermined pressure value.

In this embodiment, in relation to the control of the reversion period of the servo motor 21, it is preferable to arrange a position detector, e.g., a pulse encoder at a suitable location within a region ranging from the rotation output system of the servo motor 21 to the reciprocating section including the plungers 13A and 13B and the ball screw shaft 13 so as to supply the positions of the plungers 13A and 13B during the stroke movements to the servo control system of the motor 21.

In this case, by utilizing the plunger position detection result of the position detector along with the detected pressure values of the high pressure-side pressure gauge 64 to vary the reversing timing of the servo motor 21, it is possible to perform an operational control so as to reduce the pressurization time required for the pressure within the vessel 70 to reach a target pressure value when pressurizing the interior of the pressure vessel 70 of a known volume V to a target pressure value $p_M$.

Figure 3:
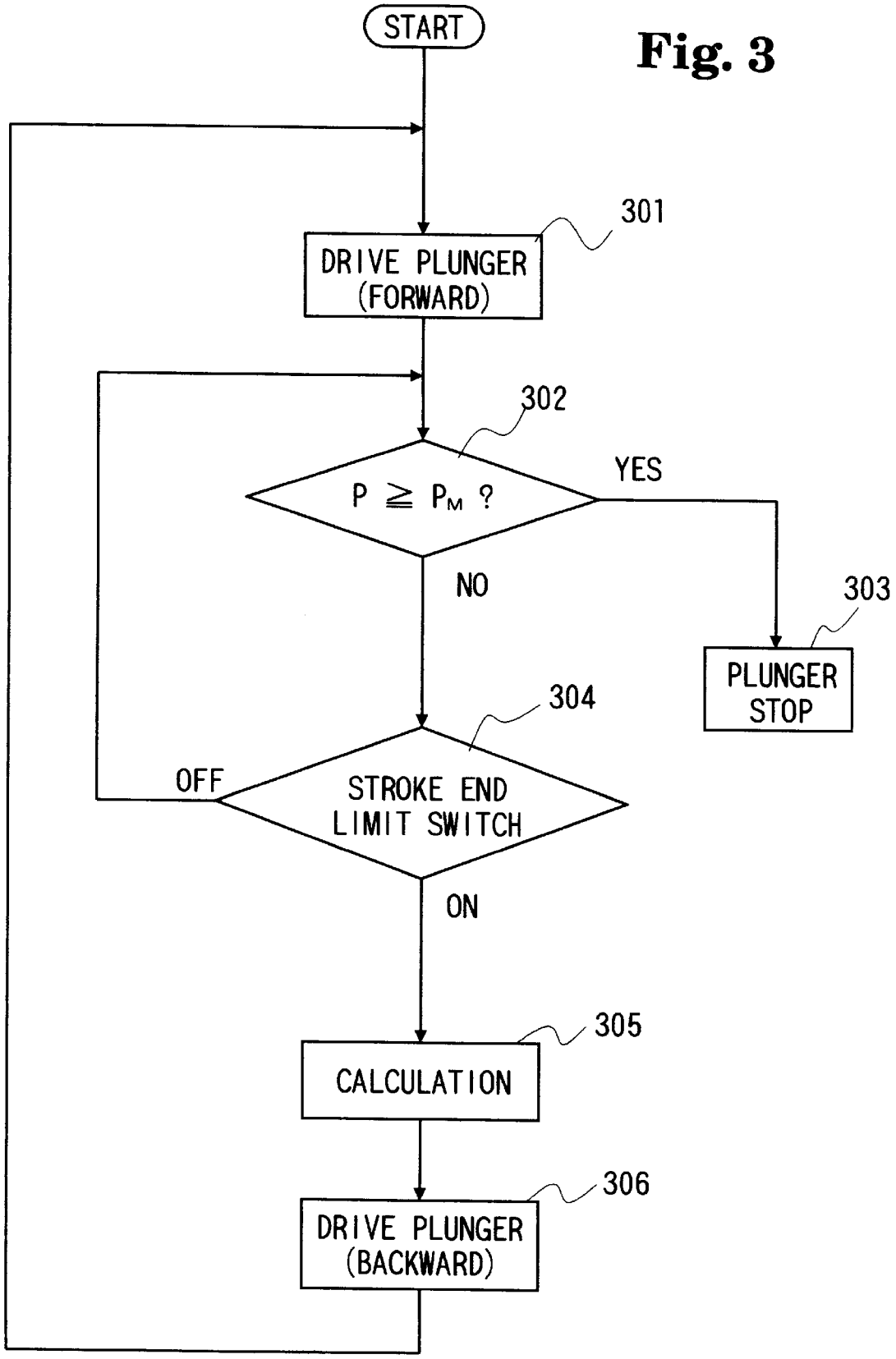
FIG. 3 is an exemplary operating flow chart of the high pressure hydraulic pump apparatus according to the first embodiment.

In other words, in this case, instead of causing the plunger pumps 10A and 10B to always reciprocate at the full stroke length, during the final stage of the pressurization the minimum amount of delivery flow required for the interior of the vessel 70 to attain the target pressure $p_M$ is calculated and the servo motor 21 is controlled so as to limit the pump stroke to the stroke length corresponding to the calculated value. This operating method will now be described with reference to FIG. 1 and FIG. 3 showing its operational flow.

Now taking the case of pressurizing the interior of the pressure vessel 70 of the known volume V to the predetermined target pressure value $p_M$ by the high pressure liquid delivered from the high-pressure plunger pump 10B, the total liquid capacity (total volume) $W_M$ within the vessel when the target pressure $p_M$ is attained by the interior of the pressure vessel 70 is first determined preliminarily from the aforesaid equation (3) in accordance with the volume V of the pressure vessel 70 and the compressibility $\beta_M$ of the working liquid at the target pressure value $p_M$.

The load pressure p within the pressure vessel 70 upon the completion of the delivery stroke of the high-pressure plunger pump 10B is obtained from the detection result of the pressure gauge 64 and then, prior to the suction stroke of the high-pressure plunger pump 10B following this delivery strokes in accordance with the compressibility β of the liquid at the obtained load pressure p and the volume V of the pressure vessel 70 the total volume W of the liquid within the pressure vessel 70 at the load pressure p is calculated from the aforesaid equations (1) and (2).

In this embodiment, water is used as the working liquid and therefore the compressibility $\beta_M$ of water upon reaching the target pressure $p_M$ (kgf/cm$^2$) is $$\beta_M=\{P(p_M)-1\}/P(p_M)$$

where $$P(p_M)=\{(2.996\times10^8+p_M\times9.8\times10^4)/2.996\times10^8\}^{0.1368}$$

In the state compressed at the compressibility $\beta_M$, the total volume $W_M$ of the required water for filling the pressure vessel 70 of the volume V is as shown by the aforesaid equation (3):

$$W_M=V/(1-\beta_M)$$

Similarly, the compressibility β of water in a given state of a load pressure p (kgf/cm$^2$) is as shown by the aforesaid equation (1):

$$\beta=\{P(p)-1\}/P(p)$$

where P(p) is $$P(p)=\{(2.996\times10^8+p\times9.8\times10^4)/2.996\times10^8\}^{0.1368}$$

Therefore, the total volume W of the required water for filling the pressure vessel 70 of the volume V with the condition of the pressure p is as shown by the aforesaid equation (2):

$$W=V/(1-\beta)$$

By thus calculating the total volume W of water from equations (1) and (2) in accordance with the value of a load pressure p at the time of completion of each delivery stroke of the high-pressure plunger pump 10B and calculating the difference between it and the total volume $W_M$ within the vessel when the interior of the pressure vessel 70 attains a target pressure value $p_M$ or $\Delta W=W_M-W$, it is determined what additional amount of compressed water must be supplied into the vessel 70 in order that its interior may attain the target pressure valie.

Assuming that $Q_0$ represents the unit delivery amount by a single pump stroke at the full stroke length of the high-pressure plunger pump 10B, the ratio $\Delta W/Q_0$ between ΔW and $Q_0$ is the number of strokes required for the pressurization up to the target pressure value. With the flow of control operations shown in FIG. 3, when the value of the ratio $\Delta W/Q_0$, calculated each time that the delivery stroke of the high-pressure plunger pump 10B is completed, is 1 or over, the plunger is driven at the full stroke length during the next suction stroke, whereas when the value of the ratio $\Delta W/Q_0$ becomes less than 1, during the immediately following suction stroke the stroke length is limited to the stroke length corresponding to the product of the full stroke length and the said ratio and moreover the pump is immediately reversed to the delivery stroke after the suction stroke at this limited stroke length.

In other words, in FIG. 3, a step 301 is an operation step whereby on starting the operation of the apparatus the servo motor 21 moves the plungers 13A and 13B, along with the ball screw shaft 13, from the stroke end in the direction of the arrow B (the low pressure-side movement limiting end) in the direction of the arrow A causing the low-pressure plunger pump 10A to effect the suction stroke and the high-pressure plunger pump 10B to effect the delivery stroke, so that when the high pressure water discharged from the pump chamber 12B is supplied to the pressure vessel 70 through the check valve 48, at a step 302 it is determined whether the load pressure has attained the target pressure value in accordance with the detection signal of the pressure gauge 64.

At the step 302, if it is confirmed that the load pressure has reached the target pressure value, the processing goes to a step 303 so that the operation of the servo motor 21 is stopped and the reciprocating movements of the plungers are stopped, whereas if the load pressure has not attained the target pressure value, the control goes to a step 304.

At the step 304, it is determined whether the plunger 13B has reached the stroke end in the direction of the arrow A (the high pressure-side movement limiting end) in accordance with the position detection result of the plunger 13B by the previously mentioned position detector. If the limiting end arrival signal from the position detector is off, it is an indication that the plunger 13B has not reached the high pressure-side movement limiting endand the flow of the control returns to the step 302 and this determination operation is repeated. When the plunger 13B reaches the high pressure-side movement limiting end, the limiting end arrival signal from the position detector is turned on and the flow of the control goes to a step 305.

At the step 305, as mentioned previously, the total volume W of the high pressure water within the vessel 70 is calculated from the previously mentioned equations (1) and (2) according to the then current value of the load pressure p taken from the pressure gauge 64 and the difference between it and a preliminarily calculated $W_M$ (the total volume of the high pressure water within the vessel 70 when the interior of the vessel 70 attains a target pressure $p_M$) or $\Delta W=W_M-W$ is calculated; and further the ratio between ΔW and a unit delivery flow $Q_0$ by a single pump stroke at the full stroke length of the high-pressure plunger pump 10B or $\Delta W/Q_0$ is calculated whereby applying to the control system of the servo motor 21 the full stroke length as a plunger movement command value when the value of the calculated ratio $\Delta W/Q_0$ is 1 or over and the limited stroke length corresponding to the product of the full stroke length and the said ratio as a plunger movement command value when the value of the ratio $\Delta W/Q_0$ becomes less than 1.

When such a plunger movement command value is applied to the servo control system, a backward movement operation of a step 306 is performed. At the step 306, the servo motor 21 causes the plungers 13A and 13B, along with the ball screw shaft 13, to move in the direction of the arrow B from the stroke end in the direction of the arrow A (the high pressure-side movement limiting end) so that the low-pressure plunger pump 10A effects the delivery stroke and the high-pressure plunger pump 10B effects the suction stroke and at this time the amount of plunger movement in the direction of the arrow B is controlled according to the command value applied at the step 305.

In other words, when the value of the ratio $\Delta W/Q_0$ calculated at the step 305 is 1 or over, the full stroke length is applied as a plunger movement command value so that the servo motor 21 moves the plungers 13A and 13B in the direction of the arrow B by the full stroke length and thereafter the control is returned to the step 301 thus changing the direction of movement to effect again the movement in the direction of the arrow A. In this case, the control of the amount of movement of the servo motor 21 according to a command value can be effected by a feedback control with a signal from an encoder for detecting the amount of movement of the mechanical output system of the servo motor 21 or simply it may be a driving direction changeover control through the operation of the position detector disposed at the low pressure-side movement limiting end.

On the other hand, when the value of the ratio $\Delta W/Q_0$ calculated at the step 305 becomes less than 1, the limited stroke length corresponding to the product of the full stroke length and the said ratio is applied as a plunger movement command value so that the servo motor 21 moves the plungers 13A and 13B in the direction of the arrow B by this limited stroke length and thereafter the control is returned to the step 301 thereby changing over the direction of movement to immediately effect the movement in the direction of the arrow A. In this case, the control of the amount of movement of the servo motor 21 according to a command value can be effected by a feedback control with a signal from an encoder for detecting the amount of movement of the mechanical output system of the servo motor 21.

Thus, according to the present embodiment the ratio $\Delta W/Q_0$ is calculated upon completion of each delivery stroke of the high-pressure plunger pump 10B so that when the value of the ratio $\Delta W/Q_0$ is 1 or over, the plunger pump is driven at the full stroke length during the following strokes, whereas when the value of the ratio $\Delta W/Q_0$ becomes less than 1, the stroke length during the immediately following suction stroke is limited to the stroke length corresponding to the product of the full stroke length and the said ratio and moreover after the suction stroke by this limited stroke length the plunger pump is immediately reversed to the delivery stroke.

By so doing, there is the effect of preventing the plunger pump to effect any pump stroke of a wasteful stroke length at the final stage of the pressurization, eliminating any waste of the stroke length during both the suction stroke and the delivery stroke to further reduce the pressurization time and allowing the interior of the load vessel to attain the target pressure value at the time of the completion of the delivery stroke at such limited stroke length as mentioned previously thereby stopping the pressurization operation of the apparatus at the step 303.

It is to be noted that if the load pressure drops from the target pressure value after the stopping of the pressurization operation, the step 305 is again started through the steps 302 and 304 and the high-pressure plunger pump 10B performs the suction and delivery strokes in an amount required for making up the decreased pressure. In this case, it is needless to say that it is preferable to provide a suitable dead zone for restarting the control flow with respect to the magnitudes of pressure drop from the target pressure value.

Now showing specific exemplary numerical values, where the pressurizing chamber of a pressure vessel of 200 cc in volume is pressurized to a target pressure of 10,000 kgf/cm$^2$ with the water pressurized by use of a high-pressure plunger pump whose unit displacement $Q_0$ per full stroke length is 10 cc, we obtain $P(p_M)=1.2197$ and the compressibility $\beta_M=0.1801$ in the aforesaid equation (3) and therefore the total volume $W_M$ of water in the vessel at the target pressure is 243.9 cc. Considering the pressurization under the atmospheric pressure, it is apparent that the vessel will be pressurized to the target pressure if an amount of water corresponding to the compression of about 40 cc is supplied after the vessel of 200 cc in volume has been filled with water.

In the case of the present embodiment, one stroke time of the high-pressure plunger pump is 25.7 seconds (10.0 seconds for the suction stroke and 15.7 seconds for the delivery stroke) and, at the time of the completion of the fourth delivery stroke or at the expiration of 92.8 seconds after the value of the load pressure by the pressure gauge 64 starting to rise due to the start of the delivery stroke following the filling of the vessel with water, the load pressure indicated 8,400 kgf/cm$^2$ so that the corresponding compressibility a was 0.1653 from equation (1) and the corresponding total volume W of water within the vessel was 239.6 cc from equation (2).

The difference A W from the total volume at the preset pressure was 4.3 cc and $\Delta W/Q_0=0.43$ with the result that the next suction stroke was limited to 43% of the full stroke length and the high-pressure plunger pump was immediately reversed to the delivery stroke after effecting the suction stroke with the stroke length of 43%. While this delivery stroke also left the remaining stroke length of 43%, when the stroke end was reached, the value of the load pressure by the pressure gauge 64 indicated the target pressure value of 10,000 kgf/cm$^2$.

In this case, during the final stroke movement in the pressure increasing operation of the high-pressure plunger pump the suction stroke and the delivery stroke were both effected with the limited stroke length of 43% and therefore the pressure increasing time up to the preset pressure was reduced as compared with the case in which every operation was effected at the full stroke length.

Figure 4:
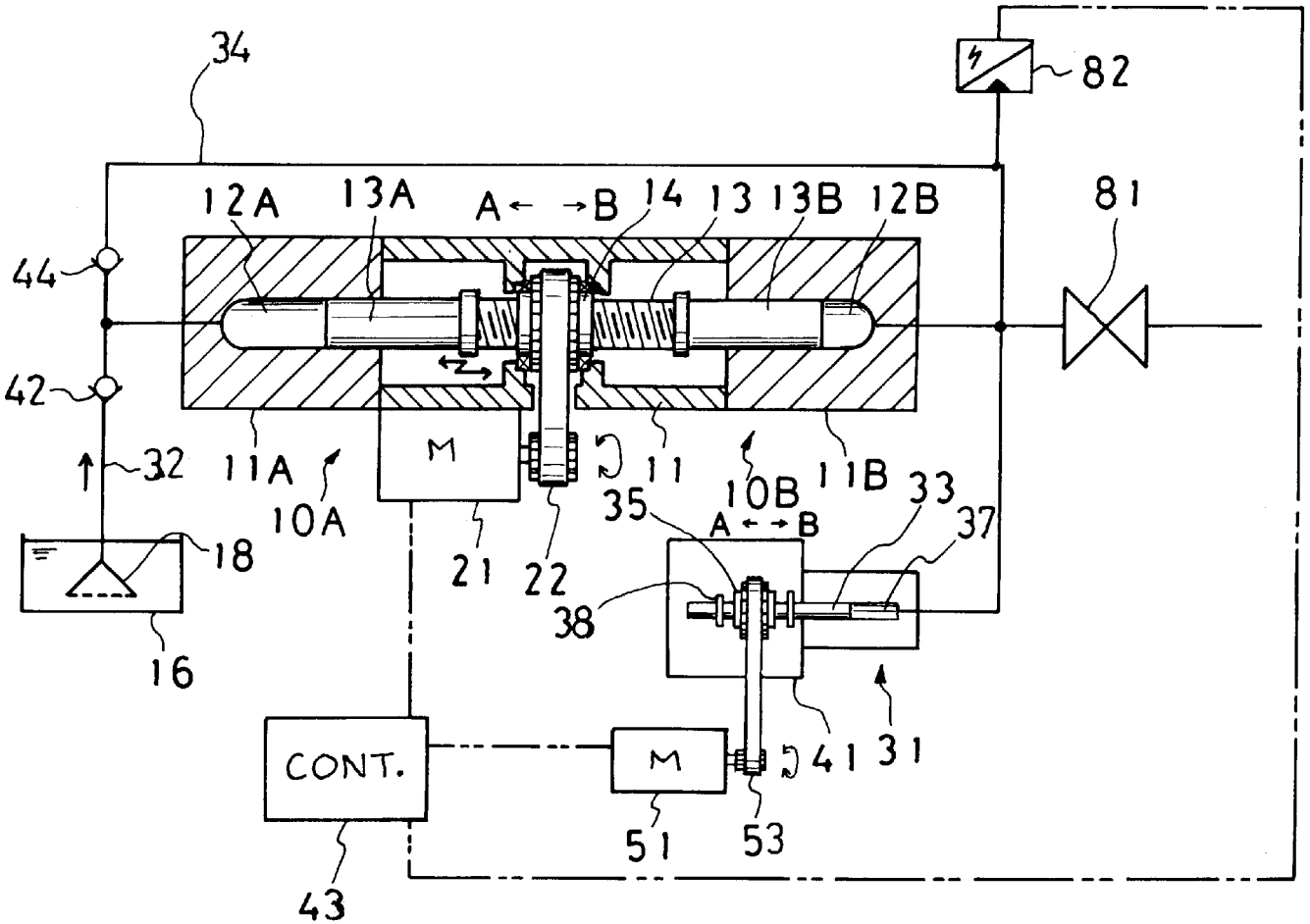
FIG. 4 is a schematic diagram showing the construction of the high pressure hydraulic pump apparatus according to a second embodiment of the present invention.

With the high pressure hydraulic pump apparatus according to a second embodiment of the present invention shown in FIG. 4, a plunger pump 10A as first reciprocating pump means, a plunger pump 10B as second reciprocating pump means and a drive system for these plunger pumps are the same in construction and basic operation with their counterparts of the first embodiment of FIG. 1. This pump apparatus further comprises a pressurizing booster 31 as third reciprocating pump means. The booster 31 of this embodiment is a kind of plunger pump and it includes a plunger 33 which reciprocates within the booster cylinder to periodically vary the volume of a pump chamber 37.

The plunger 33 continuously moves in the direction of an arrow A in the Figure to suck the liquid into the pump chamber 37 (the suction stroke) and conversely it moves in the direction of an arrow B to deliver the liquid sucked on the suction stroke (the delivery stroke).

In order to reciprocate the plunger 33 of the booster 31 by a ball screw shaft 38, mounted on a cylinder housing 41 is a drive actuator or a reversible servo motor 51 which is controlled by a servo controller 43 so as to reverse its direction of rotation, and also rotatably supported through bearings at fixed positions of the housing 41 are rotary nuts 35 which are threadedly precisely engaged with the ball screw shaft 38 through the balls, with the rotary shaft of the servo motor 51 and the rotary nuts 35 being connected by a toothed endless belt 53 forming a rotation transmission mechanism.

The liquid is stored in a reservoir 16 and a suction port 18 with a filter serving as an inlet is opened into the liquid within the reservoir 16. A supply line 32, connecting the suction port 18 and the pump chamber 12A, is provided with a first check valve 42 which is so designed that on the suction stroke of the plunger pump 10A the supply line 32 is opened to introduce the liquid sucked through the suction port 18 into the pump chamber 12A, whereas on the delivery stroke of the plunger pump 10A the supply line 32 is closed by its delivery pressure to prevent the liquid discharged from the pump chamber 12A from flowing back into the reservoir 16.

The downstream side to which the liquid flows from the pump chamber 12A is a connecting line (pressurizing processing passage) 34 and it connects the pump chambers 12A and 12B. The connecting line 34 is provided with a second check valve 44 which is opened due to the forcing of the discharged liquid from the plunger pump 10A. The check valve 44 is arranged with such orientation that the liquid flow from the pump chamber 12A side to the pump chambers 12A and 12B side is permitted and the reverse flow is blocked.

When the plungers 13A and 13B start moving as a unit in the direction of an arrow B, the plunger pump 10A enters the suction stroke so that the volume of the pump chamber 12A is gradually increased due to the movement of the plunger 13A and the liquid within the reservoir 16 is introduced by self-suction into the pump chamber 12A through the supply line 32. In this case, the pump chamber 12A side is more negative in pressure than the suction port 18 side thus opening the first check valve 42 and the pump chamber 12A side is also more negative in pressure than the connecting line 34 side thus causing the second check valve 44 to stay closed.

When the plunger 13A reverses at the stroke end of the movement in the direction of the arrow B thus starting to move in the direction of an arrow A, the plunger pump 10A enters the delivery stroke so that the volume of the pump chamber 12A is gradually decreased due to the movement of the plunger 13A and the liquid within the pump chamber 12A is discharged to the connecting line 34. The liquid discharged from the pump chamber 12A not only closes the first check valve 42 but also forces the second check valve 44 to open so as to be delivered downstream. Since the plunger pump 10B is on the suction stroke at this time, the liquid is sucked into the pump chamber 12B. In addition, the servo controller 43 is also controlling the operation of the motor 21 so that the booster 31 also enters the suction stroke in synchronism with the plunger pump 10B on the suction stroke and the liquid is also drawn into the pump chamber 37.

The volume of the pump chamber 12A is substantially equal to the total volume of the pump chamber 12B and the pump chamber 37 and the volume of the liquid corresponding to the difference in volume between the pump chambers 12A and 12B is sucked into the booster 31.

Since the pump chambers 12B and 37 are connected to the connecting line 34 and there is no check valve, as the liquid in the pump chamber 37 can be pressurized by the booster 31, the liquid in the pump chamber 12B and the connecting line 34 can also be pressurized by the booster. The pump chambers 12B and 37 and the connecting line 34 serve the role of a pressurizing chamber as a unit.

Following the suction stroke, the pressurizing stroke is started so that the booster 31 pressurizes the liquid until a predetermined pressure value is reached and the pressurized condition is maintained for a predetermined time. The plunger pumps 10A and 10B do not come into operation until the delivery stroke is started. Also, the check valve 44 is arranged in such orientation as to prevent the back flow and an outlet valve 81 is also closed thus varying the pressure value in response to the operation of the booster 31. This pressure value is detected by a pressure detector 82 at a suitable position on the connecting line 34. The detection result is fed back to the servo controller 43 to control the operation of the booster 31 in accordance with variations in the pressure value. In this way, the pressurized value and pressurizing time are controlled by the servo controller 43 to suit the kinds of liquid to be subjected to pressurizing processing and the objects of pressurization.

It is to be noted that the mounting position of the pressure detector 82 may be in the pump chamber 37 in addition to the connecting line 34, and also where the relation between the positions of the plunger 33 and the pressure values of liquid are preliminarily known, a position detector such as a pulse encoder for applying the positions of the plunger 33 during its stroke movement to the servo controller 43 of the servo motor 51 may be provided at a suitable location intermediary between the rotation output system of the servo motor 51 and the drive mechanism including the plunger 33 and the ball screw shaft 38 in place of the pressure detector 82.

When the pressurizing stroke is completed, the servo controller 43 sends an actuation signal to the servo motor 51 so that the plunger 33 operates in the reverse direction and the plunger 33 is returned. As a result, the pressurized liquid is dropped to the pressure value prior to the pressurization. Thereafter, the valve 81 is opened and also the plunger pump 10B and the booster 31 are both brought into the delivery stroke in response to the servo controller 43. Under the force of the plungers 13B and 33, the liquid in the pump chambers 12B and 37 and the connecting line 34 is discharged through the valve 81. If, for example, the valve 81 is controlled by the servo controller 43, the operation of the plungers 13B and 33 and the operation of the valve 81 can be synchronized thereby increasing the operating efficiency of the pressurized processing.

Figure 5:
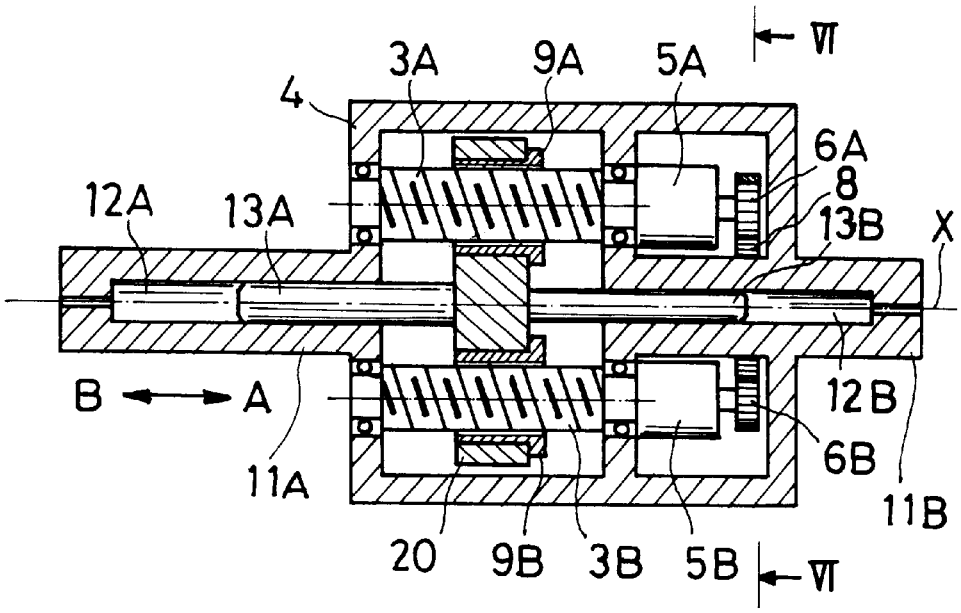
FIG. 5 is a schematic diagram showing the construction of the drive mechanism of a high pressure hydraulic pump apparatus according to another embodiment.
Figure 6:
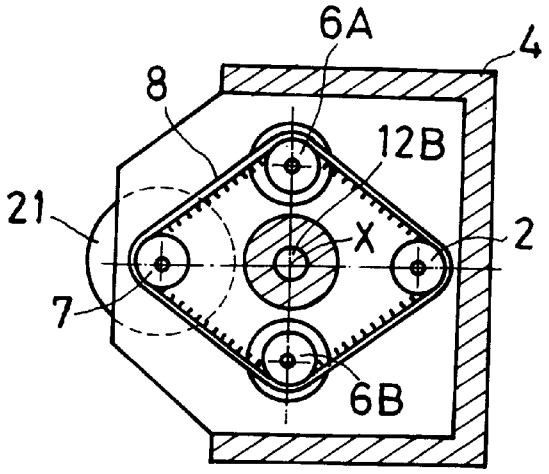
FIG. 6 is a schematic sectional view taken from the direction arrowed by VI—VI in FIG. 5

FIG. 5 is a schematic sectional view showing an exemplary suitable construction of the drive mechanism for the high pressure hydraulic pump apparatus according to the present invention. FIG. 6 is an explanatory view looked in the direction of the arrowed line VI—VI of FIG. 5.

While, in FIGS. 5 and 6, only the pair of plunger pumps and its drive mechanism constituting part of the pump apparatus are shown for purposes of avoiding complication of the illustration, it should be understood that the construction of the hydraulic system of the pump apparatus is the same with the circuit construction shown in FIG. 1 or 4.

In the drive mechanism shown in FIGS. 5 and 6, two ball screw shafts 3A and 3B, which are the same with respect to all the specification such as the screw diameter and pitch, are each rotatably supported on a housing 4 at its ends through bearings.

One end of each ball screw shaft is connected to the output shaft of a reduction gear 5A or 5B supported on the housing 4 and pulleys 6A and 6B of the same specification are respectively mounted on the input shafts of the reduction gears 5A and 5B.

As shown in FIG. 6, the reversible electric motor 21 is mounted on the housing 4 in parallel to the ball screw shafts and a pulley 7 is also mounted on the rotary shaft of the motor 21. These pulleys 6A, 6B and 7 are connected by a timing belt 8. It is to be noted that designated at reference numeral 2 in FIG. 6 is an idle pulley and this idle pulley 2 is also in mesh with the timing belt 8. The pulleys 6A and 6B are symmetrically arranged with respect to the plunger pump axial center X. Also, the pulleys 7 and 2 should preferably be arranged symmetrically with respect to the axial center X and further, if necessary, power may be applied to the pulley 2 by a separate reversible electric motor which operates in synchronism with the motor 21.

Note that while the pulleys and the timing belt are used as rotation transmitting means, a known gear mechanism may be utilized in place of them.

Nuts 9A and 9B of the same specification are respectively threadedly engaged with the ball screw shafts 3A and 3B through a large number of small balls which are not shown and the nuts 9A and 9B are integrally supported in a relatively non-rotatable manner by a traverse member 20 as a single high-strength member. The tail ends of the plungers 13A and 13B are connected to the sides of the traverse member 20 at positions along its central axis and in this case the axes of the ball screw shafts 3A and 3B are in the symmetrical positions with respect to the central axis of the traverse member 20 (i.e., the plunger pump axial center X). These ball screw shafts 3A and 3B, the nuts 9A and 9B and the traverse member 20 constitute one specific example of a motion converting unit for converting the reversible rotation output of the motor 21 to a linear reciprocating motion and transmitting it to the plungers 13A and 13B.

It is to be noted that while the drive mechanism shown in FIGS. 5 and 6 employs the two ball screw shafts 3A and 3B, a plurality of or three or more ball screw shafts may be used and the present invention is not limited to the two shafts. Where the number of the ball screw shafts is three or more, it is preferable to arrange the axial centers of the ball screw shafts parallel to and at equal angular intervals around the plunger pump axial center X.

Figure 7:
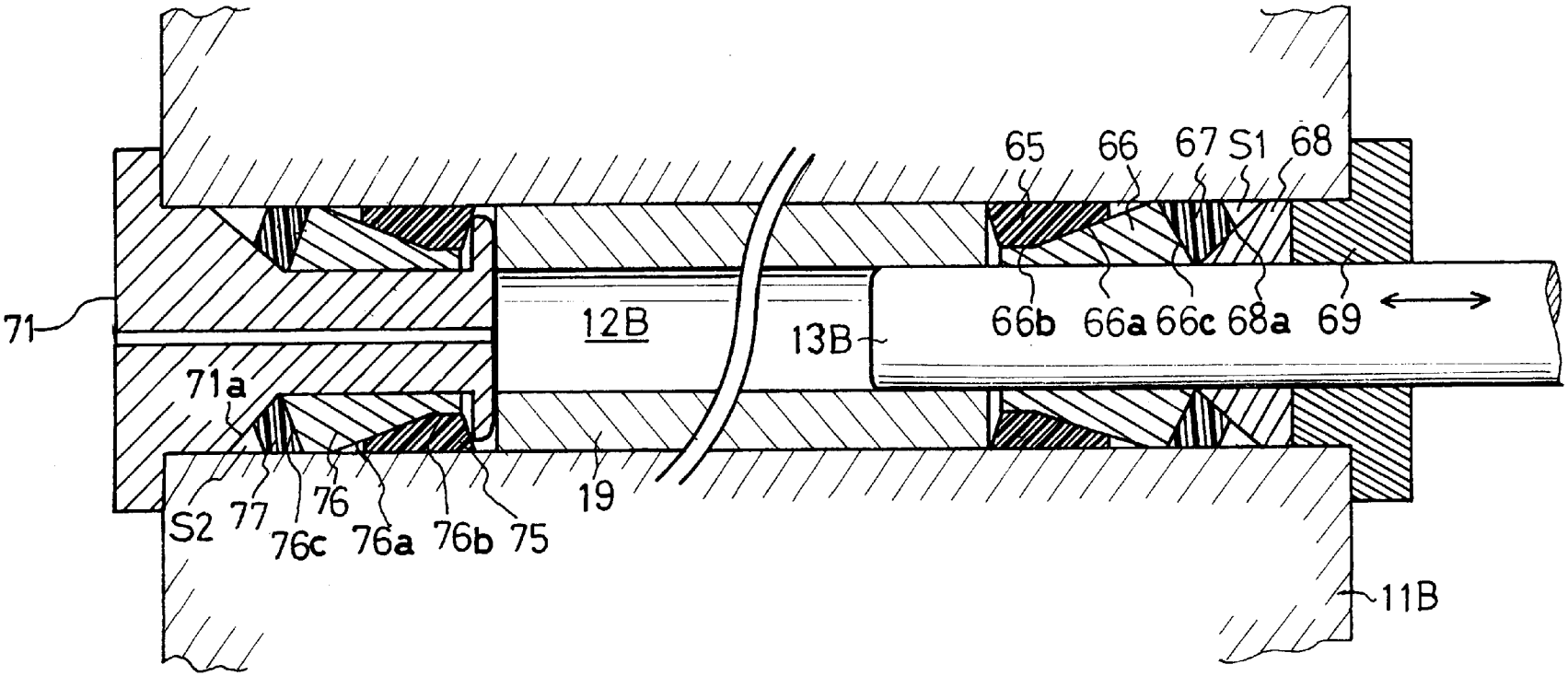
FIG. 7 is a partly-omitted sectional view showing schematically the construction of the sealing unit provided in the second plunger pump.

FIG. 7 is a partly-omitted sectional view showing an example of a suitable construction of the sealing structure for the second plunger pump (10B) which is especially required to have a high pressure resistance performance. This sealing structure includes a packing seal for the sliding portions with the plunger 13B of the plunger pump 10B (shown on the right side in FIG. 7) and a gasket seal for the fixed portion of a delivery port member 71 of the plunger pump 10B (shown on the left side in FIG. 7).

A sleeve 19 in which the plunger 13B makes reciprocating movements in contact with its inner periphery, is fitted in the inner bore of the cylinder 11B of the plunger pump 10B so as to form at each end thereof an annular gap extending over a limited axial length area.

With the packing seal for the sliding portions on the right side in FIG. 7, the annular gap is respectively defined by the right end face (first inner end face) of the sleeve 19 inside the cylinder bore and the inner end face (second inner end face) of an adapter ring 69 fixed to the cylinder 11B on the right end side of the cylinder bore.

Arranged in order from the sleeve side (the high-pressure side) within the annular gap formed between the inner periphery of the cylinder bore and the outer periphery of the plunger 13B between the first and second inner end faces are an urethane rubber resilient ring 65 of a pentagonal shape in section, a packing ring 66 made of a high polymer polyethylene which is harder than the resilient ring 65, a copper backup ring 67 of a trapezoidal shape in section and higher in yield strength than the packing ring 66, and a stainless steel bottom ring 68 (rigid ring member) formed on its end facing the inner side of the cylinder bore with a first conical end face 68*a* which is gradually increased in diameter from the left end side to the right end side. Since the bottom ring 68 is supported by the adapter ring 69 and the adapter ring 69 is fixed to the cylinder 11B, there is no danger of these rings falling off the annular gap to the outside even if an ultra-high pressure acts on the rings within the annular gap from the inside of the cylinder bore.

The resilient ring 65 is a pentagonal ring having a parallel cylindrical outer periphery facing the inner periphery of the cylinder bore, a conical inner periphery gradually increasing in diameter from the left side to the right end and apart from the outer periphery of the second plunger 13B, and a parallel cylindrical inner periphery extending to the left end from the minimum diameter portion of the conical inner periphery.

The packing ring 66 includes a parallel cylindrical inner periphery facing the outer periphery of the second plunger 13B, a conical outer periphery 66*a* gradually decreasing in diameter toward the high-pressure side, a parallel cylindrical outer periphery 66*b* connected to the reduced-diameter side forward end of the conical outer periphery 66*a*, and a second conical end face 66*c* gradually decreasing in diameter toward the right end side of the cylinder bore.

The conical inner periphery of the pentagonal ring 65 and the conical outer periphery 66*a* of the packing ring 66 face each other. Also, the outer peripheral edge of the second conical end face 66*c* of the packing ring 66 is in contact with the inner periphery of the cylinder bore over the whole periphery.

In this case, the inclination angle of the first conical end face 68*a* relative to the axial center of the bottom ring 68 is 45°, and the copper backup ring 67 is arranged within an annular space of a triangular shape in section which is formed by the first conical end face 68*a*, the second conical end face 66*c* of the packing ring 66 and the inner periphery of the cylinder bore. The backup ring 67 is of a trapezoidal shape in section having a lower base which closely contacts with the second conical end face 66c of the packing ring 66, two sides which respectively contact closely with the first conical end face 68*a* of the bottom ring 68 and with the inner periphery of the cylinder bore and an upper base, and the upper base, the first conical end face 68*a* of the bottom ring 68 and the inner periphery of the cylinder bore leave an annular space S1 of a triangular shape in section.

With the sealing structure for the sliding portions which is constructed as mentioned above, as the pentagonal ring 65 is compressed by the action of the liquid pressure from the high-pressure side, due to the conical outer periphery 66*a* of the packing ring 66, its restoring force acts, on one hand, so as to cause the packing ring 66 to decrease in diameter toward the outer periphery of the plunger 13B and, on the other hand, so as to press the outer periphery of the pentagonal ring 65 against the inner periphery of the cylinder bore. Since such restoring force of the pentagonal ring 65 acts over its whole periphery, the pentagonal ring 65 comes into close contact along its whole periphery with the inner periphery of the cylinder bore and the conical outer periphery 66*a* of the packing ring 66 and the initial sealing for the packing seal of the sliding portions is accomplished.

It is to be noted that in the case of the packing seal of the sliding portions, the packing ring comes into direct sliding contact with the sliding surface (the outer periphery of the plunger) and therefore it should preferably be made of a resin material having a relatively good lubricating quality such as a high polymer polyethylene. Also, the bottom ring should preferably be made of a rigid material such as stainless steel which has practically no danger of deformation even under the action of an ultra-high pressure thereby preventing the sliding surface from being damaged.

With the gasket seal of the fixed portion on the left side in FIG. 7, the annular gap is respectively defined by the left end face of the sleeve 19 (first inner end face) on the inner side of the cylinder bore and the inner end face (second inner end face) of the delivery port member 71 fixed to the cylinder 11B on the left end side of the cylinder bore. It is to be noted that the inner end face of this delivery port member71 is a conical end face 71*a* which is gradually decreased in diameter toward the inside of the cylinder bore and in this case the inclination angle of the conical end face 71*a* relative to the axial center of the delivery port member 71 is also 45°.

Arranged in order from the high-pressure side (the sleeve 19 side in the Figure) within the annular gap formed between the inner periphery of the cylinder bore and the outer periphery of the delivery port member 71 between the left end face of the sleeve 19 and the conical end face 71*a* are an urethane rubber ring 75 of a pentagonal shape in section, a packing ring 76 made of high polymer polyethylene and a copper backup ring 77 of a trapezoidal shape in section. Here, the portion of the conical end face 71*a* of the delivery port member 71 forms a rigid ring member corresponding to the bottom ring 68.

Similarly as the packing seal on the sliding portion side, the packing ring 76 includes a conical outer periphery 76*a* gradually decreasing in diameter toward the high-pressure side and a parallel cylindrical outer periphery connected to the reduced diameter-side forward end of the conical outer periphery 76*a*. The pentagonal ring 75 faces the inner periphery of the cylinder bore on the high-pressure side than the packing ring 76 and it is compressed between the conical outer periphery 76*a* of the packing ring 76 and the inner periphery of the cylinder bore.

The packing ring 76 includes a conical end face 76*c* which is in contact with the inner periphery of the cylinder bore along the whole peripheral edge of its maximum outer diameter portion and gradually decreasing in diameter therefrom toward the low pressure side. The copper backup ring 77 is arranged within an annular space of a triangular shape in section which is formed by the conical end face 76*c*, the conical end face 71*a* of the delivery port member 71 and the inner periphery of the cylinder bore. The backup ring 77 has a trapezoidal sectional shape having a lower base closely contacting with the conical end face 76*c* of the packing ring 76, two sides respectively in close contact with the conical end face 71*a* of the delivery port member 71 and the inner periphery of the cylinder bore and an upper base, and the upper base, the conical end face 71*a* of the delivery port member 71 and the inner periphery of the cylinder bore leave an annular space S2 of a triangular shape in section.

With the gasket seal of the fixed portion constructed as described above, when the pentagonal ring 75 is compressed under the action of the liquid pressure from the high-pressure side, due to the conical outer periphery 76*a* of the packing ring 76, its restoring force acts, on one hand, so as to cause the packing ring 76 to decrease in diameter toward the outer periphery of the delivery port member 71 and acts, on the other hand, so as to press the outer periphery of the pentagonal ring 75 against the inner periphery of the cylinder bore. Since such restoring force of the pentagonal ring 75 acts along its whole periphery, the pentagonal ring 75 comes into close contact along its whole periphery with the inner periphery of the cylinder bore and the conical outer periphery 76*a* of the packing ring 76, and the initial sealing at the gasket seal of the fixed portion is accomplished. When the plunger 13B comes into operation in the conditions where the initial sealings are accomplished for both the packing seal and the gasket seal as mentioned above, as the liquid pressure in the pressurizing chamber 12B is increased, firstly in the packing seal of the sliding portions the pentagonal ring 65 and the packing ring 66 are urged to the low-pressure side (the right side in FIG. 7) and the backup ring 67 is forced into the low-pressure side (the right side in FIG. 7) of the annular gap or the annular space S1 of the triangular shape insection along the conical end face 68*a* of the bottom ring 68 which is held within the annular gap by the adapter ring 69, with the result that both sides of the backup ring 67 are pressed as sealing surfaces under a strong force against the inner periphery of the cylinder bore and the conical end face 68*a* of the bottom ring 68 and the sealing force to the sliding surfaces by the packing ring 66 is also increased, thereby increasing the sealing force with increase in the liquid pressure and thus excellently accomplishing the sealing at an ultra-high pressure of over 500 MPa which has heretofore been impossible.

On the other hand, in the gasket seal of the fixed portion, as the liquid pressure in the pressurizing chamber 12B is increased, the pentagonal ring 75 and the packing ring 76 are urged toward the low-pressure side (to the left side in FIG. 7) so that the backup ring 77 is forced into the low-pressure side of the annular gap or the annular space S2 of a triangular shape in section and both sides of the backup ring 77 are respectively pressed as sealing surfaces under a strong force against the inner periphery of the cylinder bore and the conical end face 71*a* of the delivery port member 71, thereby increasing the sealing force with increase in the liquid pressure and thus excellently accomplishing the sealing at an ultra-high pressure of over 500 MPa.

As a result, with the plunger pump equipped at its sliding and fixed portions with the sealing structure according to the present embodiment, an excellent liquid pressure sealing is accomplished in such ultra-high pressure conditions where the liquid pressure within the pressurizing chamber is over 1,000 MPa thereby preventing leakage of the liquid to the outside of the cylinder and ensuring high sealing properties.

It is to be noted that the above-mentioned gasket seal of the fixed portion can also be utilized for sealing for example the liquid pressure inlet port and cover of the load vessel (70 in FIG. 1).

Further, the backup ring may be of a double structure including a first backup ring on the lower base side and a second backup ring on the upper base side of its trapezoidal section, and in this case the first backup ring should preferably be made of a material which is more soft than that of the second backup ring. By so doing, when considering the backup ring on the whole, the effect of deformation due to the repeated use is reduced and the life of the backup ring is made longer than previously with the resulting increase in the life of the sealing structure itself owing also to the use of no O-ring.

What is claimed is:

1. A high pressure hydraulic pump apparatus comprising:

inlet means adapted to be connected to a reservoir containing a liquid;

outlet means adapted to be connected to a load;

first reciprocating pump means for alternately sucking and delivering the liquid with a predetermined first displacement per unit stroke length;

second reciprocating pump means for alternately sucking and delivering the liquid with a second displacement per unit stroke length which is smaller than said first displacement;

drive means for synchronously driving said first and second reciprocating pump means with an equal stroke length for each other such that said second reciprocating pump means performs a suction stroke when said first reciprocating pump means is on a delivery stroke and vice versa;

a supply line for connecting said first reciprocating pump means to said inlet means when said first reciprocating pump means is on the suction stroke;

a connecting line for directing the liquid discharged from said first reciprocating pump means to said second reciprocating pump means when said first reciprocating pump means is on the delivery stroke and said second reciprocating pump means is on the suction stroke;

a delivery line for directing the liquid discharged from said second reciprocating pump means to said outlet means when said second reciprocating pump means is on the delivery stroke; and pressure control means connected to said connecting line for hydraulically controlling the pressure of the liquid in said connecting line, wherein said supply line includes a first check valve for permitting the flow of the liquid directed to said first reciprocating pump means from said inlet means and for blocking the reverse flow, wherein said connecting line includes a second check valve for permitting the flow of the liquid directed to said second reciprocating pump means from said first reciprocating pump means and for blocking the reverse flow, and wherein said pressure control means is adapted to suck an excess amount of flow which is delivered from said first reciprocating pump means and which exceeds an amount of flow sucked by said second reciprocating pump means, at a predetermined lower pressure in the vicinity of a predetermined target pressure of said load.

2. A high pressure hydraulic pump apparatus according to claim 1, wherein said pressure control means comprises a pressure accumulator connected to the delivery port of said first reciprocating pump means to suck said excess amount of flow during the delivery stroke of said first reciprocating pump means in order to store a pressure which is to be introduced into said first reciprocating pump means through said delivery port during the suction stroke thereof.

3. A high pressure hydraulic pump apparatus according to claim 1, further comprising:

a pressure detector for detecting a load pressure of a high pressure liquid delivered from said outlet means to said load; and a controller for controlling said drive means to variably control a driving stroke length of said first and second reciprocating pump means in accordance with a load pressure detected by said pressure detector and a volume of said load which is to be filled with a high pressure liquid so as to increase said load pressure to a predetermined pressure value. additionally pressurize the liquid sucked into said second reciprocating pump means; and a drive actuator for driving said third reciprocating pump means independently of said first and second reciprocating pump means, wherein said third reciprocating pump means has a third displacement which is substantially equal to the difference between said first and second displacements.

4. A high pressure hydraulic pump apparatus according to claim 1, wherein said drive means includes a motor for generating a mechanical reversible rotation output and a motion converting unit for converting the reversible rotation output taken from said motor to a linear reciprocating motion and transmitting the same to said first and second reciprocating pump means, wherein said motion converting unit includes a plurality of feed screw shafts arranged in parallel to one another so as to be driven into rotation in common by said motor, a plurality of nuts respectively threadedly engaged with said plurality of feed screw shafts so as to be moved synchronously with one another, and a traverse member for holding said nuts integrally, and wherein said first and second reciprocating pump means are both connected to said traverse member.

5. A high pressure hydraulic pump apparatus according to claim 1, wherein said first reciprocating pump means includes a first plunger pump having a first plunger, and said second reciprocating pump means includes a second plunger pump, said said first plunger of said first plunger pump having a greater pressurizing sectional area than that of said second plunger of said second plunger pump, said first plunger and said second plunger being connected in common to said drive means so as to make a reciprocating motion in unit with each other.

6. A high pressure hydraulic pump apparatus according to claim 1, wherein said pressure control means comprises valve means for relieving an excess amount of flow which is introduced from said first reciprocating pump means into said connecting line through said second check valve and which exceeds an amount of flow sucked by said second reciprocating pump means at a predetermined lower pressure in the vicinity of a predetermined target pressure of said load.

7. A high pressure hydraulic pump apparatus comprising:

inlet means adapted to be connected to a reservoir containing a liquid;

outlet means adapted to be connected to a load;

first reciprocating pump means for alternately sucking and delivering the liquid with a predetermined first displacement per unit stroke length;

second reciprocating pump means for alternately sucking and delivering the liquid with a second displacement per unit stroke length which is smaller than said first displacement;

drive means for synchronously driving said first and second reciprocating pump means with an equal stroke length for each other such that said second reciprocating pump means performs a suction stroke when said first reciprocating pump means is on a delivery stroke and vice versa;

a supply line for connecting said first reciprocating pump means to said inlet means when said first reciprocating pump means is on the suction stroke;

a connecting line for directing the liquid discharged from said first reciprocating pump means to said second reciprocating pump when said first reciprocating pump means is on the delivery stroke and said second reciprocating pump means is on the suction stroke;

a delivery line for directing the liquid discharged from said second reciprocating pump means to said outlet means when said second reciprocating pump means is on the delivery stroke;

third reciprocating pump means connected in parallel to said second reciprocating pump means for supplementing a liquid to said second reciprocating pump means so as to additionally pressurize the liquid sucked into said second reciprocating pump means; and a drive actuator for driving said third reciprocating pump means independently of said first and second reciprocating pump means, wherein said third reciprocating pump means has a third displacement which is substantially equal to the difference between said first and second displacements.

8. A high pressure hydraulic pump apparatus having a plunger pump and drive means for reciprocating a plunger of said plunger pump, wherein:

said plunger pump includes a cylinder bore in which said plunger makes reciprocating movements, an annular gap formed between an outer periphery of said plunger and an inner periphery of said cylinder bore to extend over a limited axial length area facing an end of said cylinder bore and having a first inner end face inside said cylinder bore and a second inner end face on an end side opposing said first inner end face, and a sealing structure arranged between said first and second inner end faces within said annular gap;

said sealing structure includes, as arranged in order from said first inner end face to said second inner end face, a resilient ring, a packing ring higher in hardness than said resilient ring, a backup ring higher in yield strength than said packing ring, and a rigid ring member having on said second inner end face a first conical end face gradually increasing in diameter from the inner side to the end side of said cylinder bore;

said resilient ring includes an outer periphery facing the inner periphery of said cylinder bore, and a conical inner periphery gradually increasing in diameter from the inner side to the end side of said cylinder bore and apart from the outer periphery of said plunger;

said packing ring includes an inner periphery facing the outer periphery of said plunger, a conical outer periphery facing both the conical inner periphery of said resilient ring and the inner periphery of said cylinder bore, and a second conical end face gradually decreasing in diameter from the inner side to the end side of said cylinder bore; and said backup ring includes a first end face facing the first conical end face of said rigid ring member, an outer periphery facing the inner periphery of said cylinder bore, an inner periphery facing the second conical end face of said packing ring, and a second end face forming, along with the inner periphery of said cylinder bore and the first conical end face of said rigid ring member, an annular space of a triangular shape in section on the end side of said cylinder bore.

9. A high pressure hydraulic pump apparatus comprising:

inlet means adapted to be connected to a reservoir containing a liquid;

outlet means adapted to be connected to a load chamber;

reciprocating pump means for alternately sucking and delivering the liquid with a predetermined displacement per unit stroke length;

drive means for driving said reciprocating pump means;

a supply line for connecting said reciprocating pump means to said inlet means when said reciprocating pump means is on the suction stroke;

a delivery line for directing the liquid discharged from said reciprocating pump means to said outlet means when said reciprocating pump means is on the delivery stroke;

a pressure detector for detecting a load pressure of a high pressure liquid delivered from said outlet means to said load chamber; and a controller for controlling said drive means to variably control a driving stroke of said reciprocating pump means in accordance with a load pressure p detected by said pressure detector and a volume V of said load chamber which is to be filled with said high pressure liquid so as to pressurize the interior of said load chamber up to a predetermined target pressure value $p_M$, wherein said controller comprises:

means for preliminarily calculating a total liquid volume $W_M$ within the load chamber upon the interior of the load chamber reaching the target pressure $p_M$ in accordance with the volume V and a compressibility $\beta_M$ of the liquid at the target pressure $p_M$;

means for calculating a total liquid volume W within the load chamber at the load pressure p in accordance with the volume V, the load pressure detected by said pressure detector and a compressibility S of the liquid at the load pressure p, when said reciprocating pump means is on the delivery stroke;

means for calculating a ratio $\Delta W/Q_0$ between a liquid volume difference $\Delta W=W_M-W$ and an unit delivery amount $Q_0$ by a single pump stroke at the full stroke length of said reciprocating pump means;

means for controlling said drive means so that, on the suction stroke immediately following the delivery stroke, the reciprocating pump means is driven at the full stroke length when the value of said ratio is at least 1, or at a reduced stroke length corresponding to the product of said full stroke length and the value of said ratio when the value of said ratio is less than 1; and means for controlling the reversing timing of said drive means so that, immediately after the end of the suction stroke by said reduced stroke length, said reciprocating pump means is reversed to the delivery stroke.

10. A high pressure hydraulic pump apparatus having a plunger pump and drive means for reciprocating a plunger of said plunger pump, wherein:

said drive means includes a motor for generating a mechanical reversible rotation output and a motion converting unit for converting the reversible rotation output taken from said motor to a linear reciprocating motion and transmitting the same to said plunger;

said motion converting unit includes a plurality of feed screw shafts arranged in parallel to and at equal angular intervals around the center axis of said plunger, rotation transmitting means for transmitting the reversible rotation output of said motor to said plurality of feed screw shafts in common, a plurality of nuts respectively threadedly engaged with said plurality of feed screw shafts so as to be moved synchronously with one another, and a traverse member for holding all said nuts integrally, said traverse member being connected to said plunger.

* * * * *